US005262752A

United States Patent [19]

Truong et al.

[11] Patent Number: 5,262,752

[45] Date of Patent: Nov. 16, 1993

[54] ELECTRICAL SWITCH HAVING A TWO STAGE SNAP ACTION INTERFACE FOR ENHANCED OPERATION

[75] Inventors: Kenny Truong, Roseville; Gerald W. Martin, St. Louis Park; Donald P. Kolbow; Richard B. Porter, both of Bloomington; John M. Whitney, Crystal, all of Minn.

[73] Assignee: Honeywell Inc., Minneapolis, Minn.

[21] Appl. No.: 984,749

[22] Filed: Dec. 3, 1992

[51] Int. Cl.[5] ..... H01H 37/52; H01H 37/64; H01H 37/54

[52] U.S. Cl. ..... 337/373; 337/365

[58] Field of Search ..... 337/373, 374, 375, 376, 337/362, 363, 365, 366, 342, 343, 344; 200/81.9 M

[56] References Cited

U.S. PATENT DOCUMENTS 4,499,347 2/1985 Richards ..... 200/81.9 M

*Primary Examiner*—Harold Broome

*Attorney, Agent, or Firm*—Edward Schwarz

[57] ABSTRACT

An electrical switch assembly includes a snap action switch which is actuated from one to another conduction state by a snap action interface mechanism moved by an external actuation element between first and second corresponding positions. The snap action interface mechanism prevents the snap action switch from operating improperly when the external actuation element is of the type which provides a slowly moving, low actuation force. A preferred embodiment has as a part of the interface mechanism, a lever having a ferromagnetic portion which snaps between the first and second positions under the influence of at least one magnet. The switch assembly is particularly suitable for actuation by the bimetal coil strip which commonly forms the temperature responsive element in a thermostat.

15 Claims, 2 Drawing Sheets

ELECTRICAL SWITCH HAVING A TWO STAGE SNAP ACTION INTERFACE FOR ENHANCED OPERATION

BACKGROUND OF THE INVENTION

Certain types of electrical switching applications require a mechanical switch which will operate properly with low and slow actuation force, is extremely reliable, has an accurately-repeatable response, and has a small actuation differential. These requirements arise perhaps most commonly in the electromechanical thermostats used for controlling heating and cooling in homes and buildings where coils of standard bimetal strips form the switch actuation elements. For many years this thermostatic switching function has been satisfactorily performed by mercury bulb switch elements.

Snap action switches satisfy these operating criteria in many ways, and of course do not have the environmental concerns which mercury bulb switch elements raise. By "snap action switch" in this context is meant a low actuation force switch which uses an internal mechanical apparatus to rapidly shift or snap the movable contact from one position to another to make or break electrical conduction between the movable contact and a fixed contact in response to moving an operating element of the switch such as a plunger or a lever from a first to a second mechanical position. Typically, these switches require only a few millimeters of movement by the operating element to change the conduction state of the switch. Such switches can safely and reliably operate at a current level of several amperes using the standard 24 VAC power which thermostats control. However, when actuated by a low and slow actuation force such as is provided by a thermostat's coiled bimetal strip, snap action switches may occasionally hang in a state between the two conducting states, or may switch so slowly between the two conducting states that unacceptable arcing can occur when entering the non-conducting state. Either condition gives rise to unacceptable reliability and predictability of operation. Furthermore, these switches frequently have unacceptably large differentials. By this is meant that the position of the operating element at which actuation of the switch to one state occurs, differs substantially from the position of the actuation element at which actuation of the switch to the other state occurs. If the differential is too large, then the temperature range which the controlled space experiences is also too large. Accordingly, the use of snap action switches in thermostat-type applications has to this point not been particularly successful.

BRIEF DESCRIPTION OF THE INVENTION

The problem of snap action switches improperly actuating from one to the other state when operated by low and slow actuation forces can be substantially reduced by use of a second or intermediate stage of snap action actuation which will be generally referred to as a snap action interface. In our presently preferred embodiment, the snap action interface employs the field produced by at least one magnet which interacts with a ferromagnetic portion of a lever which operates the switch. The magnet is positioned to attract the lever toward one of the positions which corresponds to a conducting state of the switch. One should note however, that a snap action interface may be developed by a mechanical linkage without the use of magnetic force, and we do not wish to exclude the various options of a completely mechanical snap action interface as part of our invention.

Thus, in its broadest form, our invention is a low actuating force electrical switch assembly having first and second conduction states and having an actuation element movable between a first range of positions and second range of positions, for changing the conduction state of the switch assembly. The assembly comprises a frame and a snap action electrical switch attached to the frame. The snap action switch has an operating element movable between first and second mechanical positions each corresponding to a different conduction state of the switch.

The snap action interface is carried on the frame and includes an output element. The interface itself operatively connects the actuation element to the output element. The interface further provides a first stable position for the output element corresponding to the first range of positions of the actuation element, and a second stable position for the output element corresponding to the second range of positions of the actuation element. The output element rapidly shifts between its first and second stable positions as the actuation element moves between its first and second ranges of positions. The output element is further operatively connected to the operating element of the switch, where movement of the output element into its first stable position moves the switch's operating element into its first mechanical position and movement of the output element into its second stable position moves the switch's operating element into its second mechanical position.

In our preferred embodiment, the interface includes a lever mounted to move between first and second positions, where the assembly's actuation element comprises an end of the lever. The lever enters its first position as the actuation element moves from its second to its first range of positions, and enters its second position as the actuation element moves from its first to its second range of positions. The lever further comprises the output element of the interface and also has a ferromagnetic portion. The interface includes at least one permanent magnet having a first flux-emitting surface and mounted on the frame in juxtaposition to the ferromagnetic portion of the lever with the flux-emitting magnet surface adjacent to the ferromagnetic portion of the lever when the lever occupies its first position. The flux-emitting magnet surface attracts the ferromagnetic portion of the lever when the lever is between its first and second positions. A spring may be used to urge the lever toward its second position. Alternatively, a second magnet or a second flux-emitting surface of the magnet may urge the lever toward its second position.

Typical magnets have an attractive force so great that if the ferromagnetic portion of the lever is allowed to directly contact the magnet surface, the low actuating force applied to the actuating element by the bimetal of a thermostat will be able to shift the lever to the other position only with a very large mechanical differential, which then translates into a large temperature differential. To solve this potential problem, non-magnetic stops are preferred to prevent the ferromagnetic portion of the lever from contacting the magnet surfaces. Each of the stops is mounted on the frame and limits the motion of the lever to define the first position of the lever as having the ferromagnetic portion thereof in spaced apart relation to the first surface of the magnet. Either or both of the stops may be adjustable, and when so, may comprise an adjustment screw carried by a bracket mounted on the frame adjacent to the lever. The adjustment screw controls the position of the lever when in the positions.

Accordingly, one purpose of the invention is to allow use of a snap action switch as the switching element in a thermostat.

Another purpose is to provide a low operating force switch not dependent on mercury as the switching element.

A further purpose is to provide a switch having a visible indication of its conduction status.

Yet another purpose is to provide an electromechanical switch requiring a relatively small force differential to change from one to another conduction state.

DESCRIPTION OF THE PREFERRED EMBODIMENTS

Figure 1:
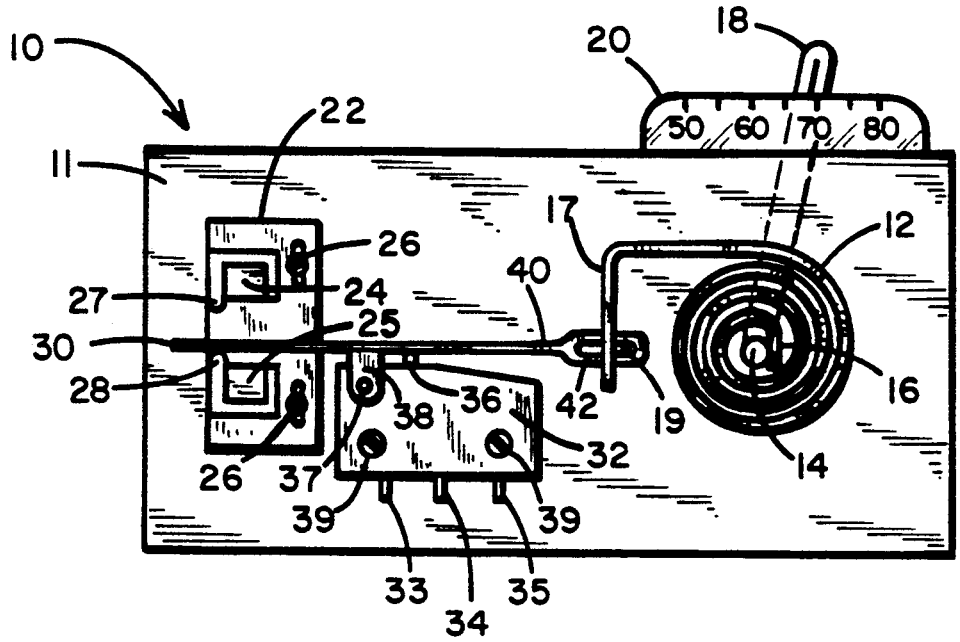
FIG. 1 shows a thermostat employing a first embodiment of the switch assembly of the invention.

Referring first to FIG. 1, the switch assembly of the first embodiment is shown as a part of a thermostat 10 which includes a frame or base 11 on which the elements of the thermostat including its switch assembly are mounted. There is a conventional coiled bimetal strip 12 which comprises the temperature sensitive element of the thermostat 10. As is well known, a bimetal strip 12 tends to coil more or less tightly as its temperature changes, causing the outer end or arm 17 of the bimetal strip to move up or down. The force generated by the outer end of the bimetal strip is very small, typically in the range of a few grams or less, and the amount of movement which the outer end undergoes for normal temperature changes is a centimeter or less. Bimetal strip 12 is mounted by its inner end 16 on a central shaft or pivot 14 which can be rotated by a room occupant through at least a few (angular) degrees by a setting lever 18. A scale 20 allows the room occupant to select the desired temperature setting. There are a number of other elements such as a heat anticipator, a control mode (heating-cooling) selector, and an on-off switch which will typically also be included in a thermostat assembly but which need not be shown in order to explain the structure and operation of the switch assembly.

In FIG. 1, the outer end 17 of the bimetal strip 12 has fastened to it a pin 19 mounted transverse or perpendicular to the movement which the bimetal strip 12 experiences as the temperature of the bimetal strip changes. The pin 19 projects past an edge of the bimetal strip 12 and forms the connection from the bimetal strip to the switch assembly of the invention.

The heart of the switch assembly is a standard snap action switch 32 such as a miniature switch Model No. UM-10A, UM-40B, or others of the "UM" family of switches available from Honeywell Inc., Minneapolis, Minn. Switch 32 is shown as having three terminals 33–35, and the conductivity between these terminals define the conduction states of switch 32. A plunger 36 forms an operating element of switch 32 and when plunger 36 is in an unactuated first mechanical position, switch 32 has a first conduction state, say with terminals 33 and 34 connected and terminals 33 and 35 unconnected. When plunger 36 is pushed into the body of switch 32 past a certain point to a second mechanical position, switch 32 is actuated, placing it in a second conduction state, say where terminals 33 and 34 are electrically unconnected and terminals 33 and 35 are now connected.

We have found that this switch 32 and others similar to it are not easily actuated by the low forces of a bimetal strip such as used here. Furthermore, if a low force, slow moving actuator such as a bimetal strip 12 provides the actuating force, there is an occasional tendency for the switch to momentarily hesitate in a central or intermediate position which does not correspond to a standard conductive state of the switch, and which may cause the temperature control system managed by the thermostat to operate in unexpected ways. Moreover, there is a substantial switching differential in these snap action switches. That is, the position of the plunger 36 at which the switch enters one of its two conduction states is substantially different from that at which it leaves that position. There is a further problem of repeatability of operation for the change in conduction state of the switch 32. That is, in the thermostat embodiment, using the bimetal strip 12 to operate plunger either directly or through a simple lever, will, result in changes in the temperature of the bimetal strip 12 at which the same change in conduction states for switch 32 occurs. These changes may occur over a relatively long time scale because of wear, and also over a short time scale from random variations in the operation of the elements perhaps arising from their interaction from one actuation cycle to the next.

The mechanism which we have chosen to transmit the movement of pin 19 to plunger 36 and also avoid the problems associated with direct actuation of plunger 36 comprises what we call a snap action interface. That is, there are two stable positions for the interface mechanism, and the snap action descriptor specifies that there is a rapid transition from one to the other of the stable positions as an actuation element of the interface mechanism is moved between first range of positions and a second range of positions.

In FIG. 1, plunger 36 is operated by an actuating lever 40 to change the conduction state of switch 32, and the part of a lever 40 which is connected to pin 19 comprises the actuation element. Lever 40 comprises a narrow strip of a material stiff enough to eliminate any appreciable bending during operation. Lever 40 includes a ferromagnetic portion 30 extending between a pair of magnets 24 and 25 and in fact the entire lever is preferably made from a mild, low remanence steel. Lever 40 further includes a first tab 38 bent down at 90° from the plane of the lever and a second tab located on the opposite side of the lever from the first tab 38, and similarly bent down from the plane of the lever 40 and hidden by the first tab 38 and the switch 32 body. These first and second tabs 38 have concentric bearing journal holes in which closely fit a first bearing shaft 37 on the housing of switch 32 projecting toward the viewer of FIG. 1 and a second bearing shaft not shown which projects away from the viewer on the hidden side of switch 32's housing. Tabs 38 may be bent over the first and second bearing shafts 37 or may have sufficient flexibility to allow them to be slipped over the ends of the bearing shafts 37. The bearing shafts 37 are located so that when the bearing journals in tabs 38 are mounted on them, a point of lever 40 facing switch 32 contacts and depresses plunger 36 as lever 40 is rotated clockwise.

Lever 40 extends from bearing shafts 37 toward bimetal strip 12 and is rotated about shafts 37 by force provided by bimetal strip 12 as its temperature changes. The pin 19 carried at the outer end 17 of strip 12 fits within a slot 42 at the end of lever 40 adjacent to the outer end 17 of strip 12. The width (vertical dimension as shown in the Fig.) of slot 42 must closely match the diameter of pin 19 to avoid as much backlash between the walls of slot 42 and pin 19. Slot 42 and pin 19 thus together form a type of Scotch yoke, so that little radial force is imposed on the outer strip end 17 by lever 40.

Lever 40 further includes a cantilevered ferromagnetic extension portion 30 extending from tabs 38 oppositely from the slot-carrying end of lever 40. The pair of magnets 24 and 25 are disposed on opposite sides of lever extension 30 so that as lever 40 rotates clockwise, lever extension 30 approaches magnet 24 and as lever 40 rotates counterclockwise, lever extension 30 approaches magnet 25. Magnets 24 and 25 are mounted on a support 22 which is fastened in turn to frame 11 by screws 26. The placement and spacing of magnets 24 and 25 is such that the lever extension 30 is magnetically attracted by magnet 24 before lever 40 has rotated sufficiently in a clockwise direction to change the state of switch 32 by depressing plunger 36. Similarly, lever extension 30 is attracted by magnet 25 before lever 40 has rotated sufficiently in a counterclockwise direction to change the state of switch 32 by releasing plunger 36. Stops 27 and 28 are shown as integral with support 22, and interrupt movement of lever extension 30 as it respectively nears magnets 24 and 25 during rotation of lever 40. These stops 27 and 28 prevent lever extension 30 from directly contacting the surfaces of magnets 24 and 25. These stops 27 and 28 are necessary because the typical field strength of magnets 24 and 25 is so high that it will be difficult for the force created by bimetal strip 12 to overcome the attraction between lever extension 30 and a magnet 24 or 25 if they touch.

In operation, as air temperature changes, the temperature of bimetal strip 12 changes also, causing the outer end 17 and more importantly, the pin 19, to move up or down depending on the sense of the temperature change. In explaining the design considerations for the operation of the switch assembly, assume that at a certain time the plunger 36 is in its released position as shown in FIG. 1, and the temperature change causes the outer end 17 of bimetal to fall. After downwardly directed force from end 17 exceeds a certain level, extension arm 30 will break away from its attraction to magnet 25. The spacing of magnets 24 and 25 and stops 27 and 28, the stiffness of arm 40, the force with which lever extension 30 is attracted to magnets 24 and 25, and the characteristics and position of switch 32, are such that lever extension 30 rapidly snaps from a point adjacent one of the stops 27 and 28 to a point adjacent the other of the stops without occupying an intermediate stage where lever extension 30 is in contact with neither stop 27 nor 28. This rapid rotation of lever 40 under the attraction of magnet 24 is sufficient to rapidly move plunger 36 through the position at which the conductive state of switch 32 is changed. Thus, during this transition of lever extension 30 from stop 28 to stop 27, switch 32 changes conductive state, so that conduction occurs between a different pair of terminals 33–35. Switch 32 and the various elements and their characteristics must insure that plunger 36 has not been depressed enough to change the conductive state of switch 19 or alter significantly the internal contact pressure of switch 32 before the transition of lever extension 30 from stop 27 to stop 28. Selection of the various specifications for the elements of the interface mechanism are well within the capability of persons having ordinary skill in the design of such devices.

While not currently preferred, it is possible to select the design parameters of stiffness of arm 40, the characteristics of the magnets 24 and 25, their attraction for lever extension 30, and the spacing between the stops 27 and 28 to cause extension 30 to enter and remain for a time in an intermediate position between stops 27 and 28. In this intermediate condition, it is necessary that the contact to contact pressure within switch 32 not drop appreciably. And in this type of design, it is important that the conduction state of switch 32 change only when the rapid, magnetically-induced rotation of lever 40 pulls extension 30 into contact with stop 27 or 28. In this way, the possibility is reduced of the switch changing state so slowly that undesirable arcing occurs, or the contact to contact resistance becoming unacceptably high. Of course, there will be no visual indication of the conductive state of the switch when lever 40 is in this intermediate state.

Figure 2:
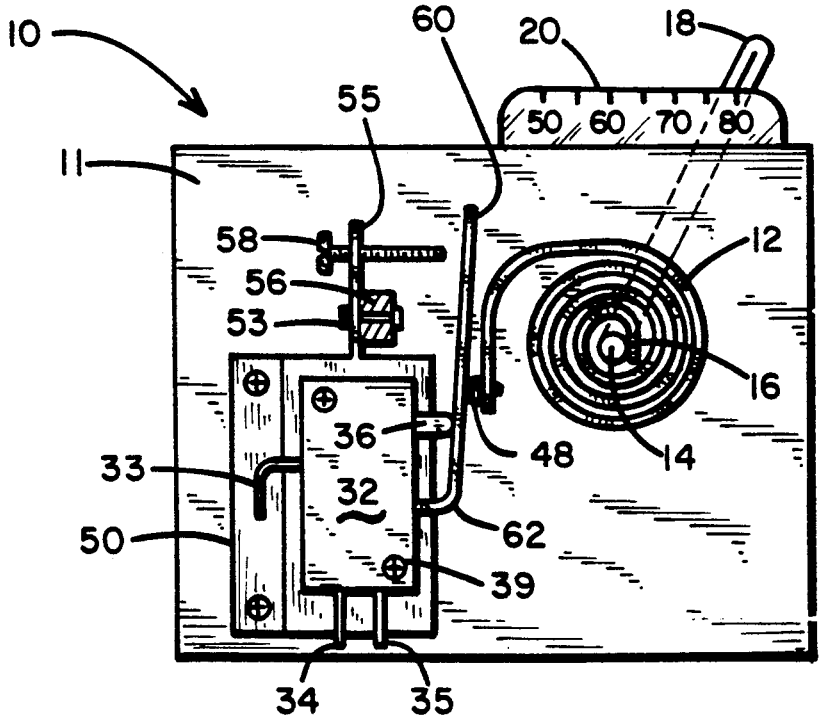
FIG. 2 shows a thermostat employing a second embodiment of the switch assembly of the invention.

It is also possible to use a magnet's flux-emitting surface on only one side of lever extension 30, and rely on an internal spring within switch 32 or an external spring to allow the switch 32 to cleanly change its conductive state. This is the feature of the interface mechanism of FIG. 2. In FIG. 2, the elements similar to those of FIG. 1 have been given similar reference numerals. Switch 32 is mounted on a plate 50 which is a part of the frame 11 by screws 39. A ferromagnetic lever 60 has an end 62 mounted for low friction rotation on the housing of switch 32. As shown in FIG. 2, lever 60 is in a first position. Spring force is applied to lever 60 by plunger 36 urging lever 60 into clockwise rotation. The rotational mounting of end 62 also allows lever 60 to rotate counterclockwise into a second position when force applied to its cantilevered end opposes the clockwise torque created by plunger 36. Counterclockwise rotation of lever 60 shifts plunger 36 toward its second mechanical position in which switch 32 is actuated to enter its second conduction state. Force urging lever 60 into counterclockwise rotation is provided by bimetal strip 12 through a low-friction plastic button 48.

The snap or hysteresis action for this interface between the bimetal strip 12 and the plunger 36 arises from the presence of a magnet 53 held in a position which attracts the cantilevered end of lever 60 toward its second position. Magnet 56 is held in the position shown by a rivet 53 which fastens magnet 56 to a bracket 55 mounted on frame 11. The clockwise torque generated on lever 60 by the position and spring rate of plunger 36, the force applied to lever 60 by bimetal strip 12, and the attraction of magnet 56 for lever 60, all combine to determine which of its two positions lever 60 assumes.

Bracket 55 further has a threaded hole in which is held an adjustment screw 58 to control the spacing between lever 60 in its second position and the flux-emitting surface of magnet 56 which faces lever 60. Adjustment screw 58 thus provides the same function as do stops 27 and 28 of FIG. 1.

As the temperature sensed by bimetal strip 12 changes so as to cause strip 12 to uncoil for example, the outer end of strip 12 applies force to lever 60 opposing the torque caused by spring section 62 and rotating lever 60 counterclockwise toward magnet 56. When the torque applied on lever 60 by magnet 56 plus the torque generated by bimetal strip 12 force is greater than the resultant torque on lever 60 arising from the combination of spring section 62 torque and the torque from the spring loading on plunger 36, then lever 60 snaps into its second position where it is in contact with adjustment screw 58. As is well known of course, the magnetic force of a magnet on a ferromagnetic object attracted to it increases rapidly with decreasing space between its flux-emitting surface and the object, so once this force or torque balance is reached, then there is a rapid transition between the first and second positions of lever 60. The various dimensions and placements of the elements in this linkage and of switch 32 should be such that switch 32 changes state during this transition by lever 60 from its first to its second position. This assures that the change in state of switch 32 is clean, with no hesitation between switch states.

As the temperature sensed by bimetal strip 12 later changes so as to cause strip 12 to coil further, a point is reached where the magnetic attraction for the cantilevered end of lever 60 plus the force from strip 12 can no longer hold lever 60 against adjustment screw 58. The torque applied to lever 60 by plunger 36 cause lever 60 to break loose from attraction by magnet 56, and lever 60 rapidly snaps back into its first position. Again, the arrangement of the various elements of the switch assembly should cause switch 32 to change state during this rapid transition back to the first position of lever 60.

Figure 3:
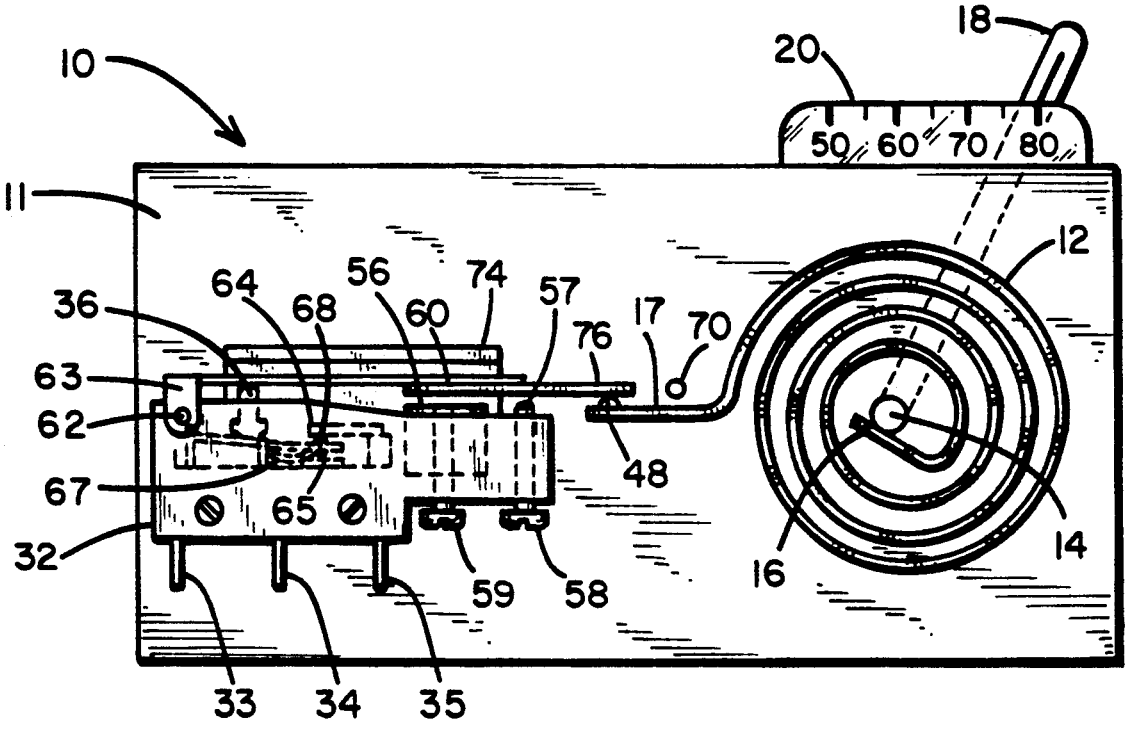
FIG. 3 shows a thermostat employing a third embodiment of the switch assembly of the invention.

FIG. 3 shows yet another variation of the concept of this invention. Reference numbers for similar elements in FIG. 3 are the same as those used in FIGS. 1 and 2. The thermostat of FIG. 3 also uses a magnet as an element of the intermediate snap action interface stage. However, in this design gravitational force on a lever 60 operates the switch plunger 36. This arrangement seems to allow a relatively small thermostat differential which is a very desirable characteristic.

Lever 60 has a downwardly projecting tab 63 which is journalled on a stub shaft 62 projecting from the side of switch 32, allowing lever 60 to rotate about shaft 62. In the embodiment shown, lever 60 has a ferromagnetic armature portion 76 at its end. It is also possible to fashion lever 60 out of a single piece of ferromagnetic material. Lever 60 is mounted in an approximately horizontal position and has appreciable weight. A combination dust shield and lever stop 74 extends along the top surface of lever 60. Lever 60 operates a plunger 36 of switch 32 which in turn operates a switch blade generally indicated at 67 and at whose end is carried a movable contact 68 of switch 32. Movable contact 68 is shifted into contact with contacts 64 and 65 accordingly as plunger 36 is allowed to assume its released or actuated position. Plunger 36 is spring biased upwardly either by switch blade 67 or by a separate spring not shown. The thermostatic control operation arises from the variable force applied to the end of lever 60 by arm 17 of bimetal strip 12 as temperature changes are sensed by the strip 12. Gravitational force on arm 60 constantly urges arm 60 downwards against the force of strip 12. An antifriction button 48 made from some low-frictional coefficient plastic material prevents deviations in the actuation temperature arising from friction between arm 17 and lever 60. The extent of travel allowed for bimetal strip arm 17 is limited in our embodiment by a stop 71, deemed necessary to prevent bending of lever 60 by the relatively high forces which bimetal strip might generate should the thermostat 10 be exposed to relatively high temperature, such as during the summer. Obviously, when the temperature falls to an unexpectedly low level, arm 17 can drop to far below lever 60 without damaging it.

The intermediate snap action stage in this embodiment comprises the ferromagnetic armature 76, a magnet 56 embedded within the housing of switch 32, and a lever stop 57. The vertical positions of magnet 56 and stop 57 are controlled by adjustment screws 59 and 58 respectively. Attraction by magnet 56 for the ferromagnetic portion 76 of lever 60 urges lever 60 clockwise toward contact with the stop 57. The weight of lever 60 creates a moment on lever 60 sufficient to depress plunger 36 until lever 60 comes within the range of attraction by magnet 56. When arm 60 is in contact with stop 57, switch 32 must be actuated with switch blade 67 holding movable contact 64 in electrical contact with fixed contact 65. The adjustment provided by screw 58 for setting the position of stop 57 allows proper operation of the switching function, with switch 32 setting reliably when lever 60 contacts stop 57, and returning to its released position when arm 60 is rotated to a position spaced from stop 60.

The angular position of lever 60 is controlled by the resultant of the various sources of moments imposed on lever 60. These moments arise from forces generated by the spring loading of plunger 36 and the variable moment from arm 17 of bimetal strip 12 which each urge the lever 60 in a counterclockwise direction, and magnet 56 and gravity urging the lever 60 in a clockwise direction. As temperature drops, strip 12 coils more tightly, causing arm 17 to drop. Lever 60 follows under the force of gravity and the magnetic attraction of magnet 56. At some point, the magnetic attraction for armature 76, which is non-linear of course and increases as the armature nears magnet 56, overcomes the moment on lever 60 arising from the force of arm 17. At this point, magnet 56 rapidly pulls armature 76 into contact with stop 57 causing switch 32 to actuate and contact 68 to snap into contact with contact 65. It is assumed that this electrical connection will cause a heating plant to warm the air within the enclosure where thermostat 10 is mounted.

As temperature increases due to heating plant operation, bimetal strip 12 uncoils and its arm 17 rises and applies increasing force to lever 60. At some point, this increasing force plus the force applied by plunger 36 creates a moment on lever 60 which is greater than that arising from the opposing (clockwise) force of magnet 56 and gravity. At this point, lever 60 breaks away from the attraction of magnet 56 and rapidly lifts or rises due to the resiliency in bimetal strip 12 and the spring loading on plunger 36, causing plunger 36 to return to its released position and switch 32 to deactuate. Arm 17 may continue to rise until it contacts stop 71. The natural resilience of bimetal strip 12 allows substantial further uncoiling without changing the characteristics of its response to temperature changes. It is important that movable contact 68 shifts from contact with one fixed contact 64 or 65 to the other during the movement of lever 60 while under the influence of magnet 56. The adjustments on stop 57 and magnet 56 allow this relationship to be formed. By requiring this condition, the switch 32 passes through its switching transition cleanly and the dead break condition does not occur.

At the present time we prefer a magnet to provide the hysteresis in the operation of the snap action interface between the bimetal strip 12 and switch 32. It is entirely possible however, that a wholly mechanical snap action interface can be devised to provide the hysteresis operation.

With any of these interface mechanisms, we have found that the relatively low and slowly acting force generated by a bimetal strip in a thermostat can cause rapid, repeatable, and reliable changes in the conduction state of a common snap action microswitch. Accordingly, we now believe that such a microswitch in combination with such an interface mechanism can be used as a substitute for a mercury switch in a thermostat.

We claim:

1. A low actuating force electrical switch assembly having first and second conduction states and having an actuation element movable between a first range of positions and second range of positions, for changing the conduction state of the switch assembly, and comprising a) a frame;

b) a snap action electrical switch attached to the frame, said switch having an operating element movable between first and second mechanical positions each corresponding to a different conduction state of the switch; and c) snap action interface means carried on the frame and including an output element, and operatively connecting the actuation element to the output element, for providing a first stable position for the output element corresponding to the first range of positions of the actuation element, and for providing a second stable position for the output element corresponding to the second range of positions of the actuation element, said output element rapidly shifting between its first and second stable positions as the actuation element moves between its first and second ranges of positions, said output element further operatively connected to the operating element of the switch, where movement of the output element into its first stable position moves the switch's operating element into its first mechanical position and movement of the output element into its second stable position moves the switch's operating element into its second mechanical position.

2. The switch assembly of claim 1, wherein the interface means comprises a) a lever mounted to move between first and second positions and wherein the actuation element comprises a portion of the lever, with the lever entering its first position as the actuation element moves from its second to its first range of positions, and with the lever entering its second position as the actuation element moves from its first to its second range of positions, the lever further comprising the output element and having a ferromagnetic portion; and b) at least one permanent magnet having a first flux-emitting surface and mounted on the frame in juxtaposition to the ferromagnetic portion of the lever with the flux-emitting magnet surface adjacent to the ferromagnetic portion of the lever when the lever occupies its first position, said flux-emitting magnet surface attracting the ferromagnetic portion of the lever when the lever is between its first and second positions.

3. The switch assembly of claim 2, further comprising a first non-magnetic stop mounted on the frame and limiting the motion of the lever to define the first position of the lever as having the ferromagnetic portion thereof in spaced apart relation to the first surface of the magnet.

4. The switch assembly of claim 2 wherein the magnet includes a second flux-emitting surface adjacent to the ferromagnetic portion of the lever when the lever occupies its second position, said second flux-emitting magnet surface attracting the ferromagnetic portion of the lever when the lever is between its first and second positions.

5. The switch assembly of claim 4, further comprising first and second stops mounted on the frame and limiting the motion of the lever to respectively define the first and second positions of the lever as having the ferromagnetic portion thereof in spaced apart relation to the first and second surfaces of the magnet.

6. The switch assembly of claim 5 having a preselected spacing between the points of the first and second stops contacted by the lever, and having a lever having a preselected flexibility, wherein the lever during actuation shifts rapidly between its first and second positions.

7. The switch assembly of claim 5, wherein the lever includes a tab having a bearing and the switch includes a housing having a journal projecting therefrom into the bearing for mounting the lever for rotation on the housing.

8. The switch assembly of claim 7, further comprising an arm mounted on the frame for supplying actuation force to the lever, said arm including a pin extending transversely to the motion of the arm, said pin forming a part of a Scotch yoke and said arm including an area having a slot forming a part of the Scotch yoke.

9. The switch assembly of claim 2, further comprising an arm mounted on the frame for supplying actuation force to the lever, said arm including a pin extending transversely to the motion of the arm, said pin forming a part of a Scotch yoke and said arm including an area having a slot forming a part of the Scotch yoke.

10. The switch assembly of claim 2, wherein the arm includes a cantilevered portion comprising the ferromagnetic portion.

11. The switch assembly of claim 2, wherein the interface means further comprises a) a bracket mounted on the frame adjacent to the lever, said bracket having a threaded hole in it whose axis intersects the lever surface, and an adjustment screw in the threaded hole of the bracket, and b) a spring mechanically connected to the lever and urging the lever away from the magnet.

12. The switch assembly of claim 2, wherein the interface means further comprises a bracket mounted on the frame adjacent to the lever and on the same side of the lever as is the magnet, said bracket having a threaded hole in it whose axis intersects the lever surface, and an adjustment screw in the threaded hole of the bracket, and b) a spring in mechanical connection to the lever and urging the lever away from the magnet.

13. The switch assembly of claim 2, wherein the lever is to be mounted in an approximately horizontal position and has appreciable weight, said weight creating a moment on the lever affecting movement of the lever between its first and second position.

14. The switch assembly of claim 13 for use in a thermostat having a bimetal strip sensing element having an outer arm in mechanical connection with the lever, said sensing element having appreciable resilience.

15. The switch assembly of claim 2 for use in a thermostat having a bimetal strip sensing element having an outer arm in mechanical connection with the lever, said sensing element having appreciable resilience.

* * * * *